United States Patent [19]

Hagemeister

[11] Patent Number: 4,893,674

[45] Date of Patent: Jan. 16, 1990

[54] METHOD OF PRODUCING A TUBULAR DISTRIBUTOR OF A HEAT EXCHANGER FROM JUXTAPOSED POROUS STRIPS OF MATERIAL

[75] Inventor: Klaus Hagemeister, Munich, Fed. Rep. of Germany

[73] Assignee: MTU Motoren-und Turbinen-Union Munchen GmbH, Munich, Fed. Rep. of Germany

[21] Appl. No.: 259,183

[22] Filed: Oct. 18, 1988

[30] Foreign Application Priority Data

Oct. 23, 1987 [DE] Fed. Rep. of Germany ..... 3735846

[51] Int. Cl.[4] ..... F28D 7/06

[52] U.S. Cl. ..... 165/176; 29/157.3 R; 29/157.4; 165/79

[58] Field of Search ..... 29/157.3 R, 157.4; 165/79, 176

[56] References Cited

U.S. PATENT DOCUMENTS

| | | | |
|---|---|---|---|
| 4,512,069 | 4/1985 | Hagemeister | 165/176 X |
| 4,577,684 | 3/1986 | Hagemeister | 165/178 X |
| 4,597,436 | 7/1986 | Hagemeister et al. | 29/157.4 X |
| 4,698,888 | 10/1987 | Hagemeister | 29/157.4 X |
| 4,800,955 | 1/1989 | Hagemeister et al. | 165/176 X |
| 4,809,774 | 3/1989 | Hagemeister | 165/176 X |

*Primary Examiner*—Gerald A. Michalsky

*Attorney, Agent, or Firm*—Roberts, Spiecens & Cohen

[57] ABSTRACT

A method for manufacturing a tubular distributor of a heat exchanger in which the distributor is formed by layers of material between which the ends of heat exchange tubes of a matrix are secured in fluid-tight manner. The layers are made of fibers which are juxtaposed between the tube ends of adjacent rows and the layers are deformed by compression so that they each engage around one-half of the associated row of tubes to form an initially porous structure into which a metallic material is injected to integrate the fibers of the layers with one another and with the ends of the tubes in sealed relation.

20 Claims, 6 Drawing Sheets

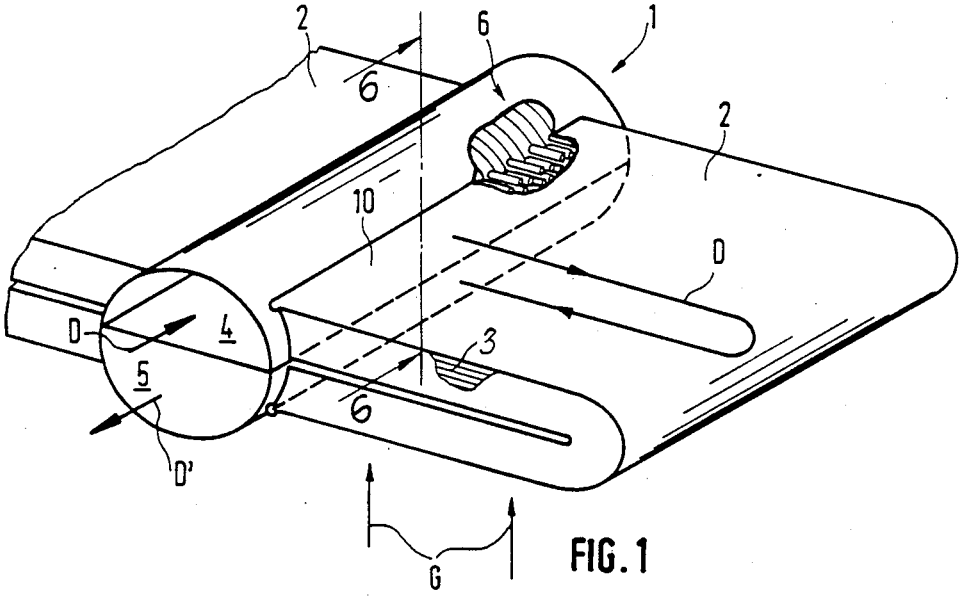
FIG. 1
FIG. 2
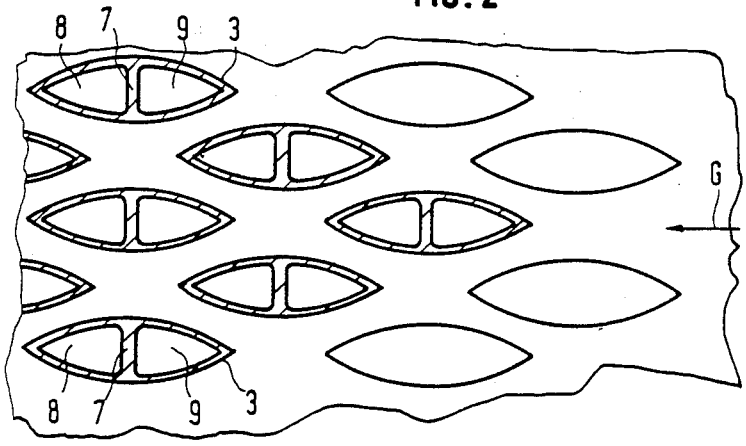

METHOD OF PRODUCING A TUBULAR DISTRIBUTOR OF A HEAT EXCHANGER FROM JUXTAPOSED POROUS STRIPS OF MATERIAL

FIELD OF THE INVENTION

The invention relates to a method of producing a tubular fluid distributor of a heat exchanger from a succession of juxtaposed strips in which the ends of heat exchange tubes are mounted in sealed relation.

DESCRIPTION OF PRIOR ART

One method of manufacturing a fluid distributor of a heat exchanger is known from U.S. Pat. No. 4,597,436 in which a tubular distributor is assembled from a plurality of very precisely preformed or preprofiled elements corresponding to the number and the desired spacing of the profiled heat exchange tubes of a tube matrix. The elements are assembled as layers one on the other and the layers are predeformed so that each surrounds only one-half of the ends of the heat exchange tubes in form-locked manner.

This arrangement has the disadvantage that, despite relatively precise manufacture of the corresponding elements forming the layers, manufacturing tolerances must be taken into account, so that the total length of the tubular distributor to be produced varies with the sum of the thickness tolerances of the elements. In addition to variations in the length of the distributor, local offsets of recesses for the tubes with respect to the prescribed spacing and arrangement of the tubes is also produced. In mass production of the elements, therefore, manufacturing tolerances cannot be avoided and can be corrected, if possible, in practice only by extremely expensive subsequent machining.

Any offset of the openings for the tubes and even only slight variations in the shape of the openings, make necessary a tedious fine adjustment or centering of the corresponding ends of the tubes, particularly as the subsequent joinder of the tube ends in the tubular distributor (for example, by soldering, welding or brazing), demands an extremely accurate, seated fitting of the tube ends in order to minimize local displacements of the joining material as much as possible.

In another known method as disclosed in U.S. Pat. No. 4,698,888, the preformed elements are produced by a rolling operation. The assembly of the preformed elements suffers from the same disadvantages as noted above.

SUMMARY OF THE INVENTION

An object of the present invention is to provide a method which avoids the problems concerning manufacturing tolerances of the layers which make up the tubular distributor, and in the location of the openings for receiving the ends of the heat exchange tubes.

A further object of the present invention is to provide a method in which the tube ends of a tube matrix of a heat exchanger can be effectively secured in integrated fashion in a tubular distributor structure which is produced from elements which avoid the use of solid structural parts.

In accordance with the objects of the invention, there is provided a method in which successive layers of strips of fiber material are assembled in juxtaposed relation with the ends of rows of heat exchange tubes interposed between adjacent strips whereafter compressive forces are applied to the strips to squeeze the strips and deform the strips around the tubes to form a porous structure in which the tubes are encased. By virtue of this method, the need for precision construction of the layers with small tolerances as taught by the art is eliminated, and the seating of the ends of the tubes in the porous structure is automatically obtained by conformance of the strips around the tubes when the strips are deformed.

The porous structure is then filled with a liquid, metallic material to integrate the fibers of the strips with one another and with the ends of the tubes to form a solid assembly in which the ends of the tubes are sealingly secured.

The invention is characterized in that instead of using annular strips of solid material, the strips are made of fiber material. Upon assembly of the strips, formed as flat annular layers, on the heat exchanger tubes, the fiber material is compressed under the action of axial compressive forces and the fiber material completely surrounds the interposed heat exchange tubes. The compressing of the fiber material is greatest locally where the surfaces of adjacent tubes in the heat exchanger field are at the smallest distance from each other.

The metallic material (metal matrix) acts to fill the hollow spaces in the fiber structure and produce a secure, integrated connection between the surfaces of the tubes and the surrounding fiber material.

The formation of the strips of fiber material is effected as follows in accordance with the invention.

The strips are annular in form i.e. cylindrical, oval, rectangular, and in the circumferential direction, one portion of the fiber material is desirably oriented in order to resist high circumferential forces which are developed due to internal pressure in the distributor during operation of the heat exchanger. Another portion of the fiber material extends in bristle-like manner from the lateral surfaces of each fiber strip so that upon assembly, the bristles of adjacent strips interpenetrate one another and, after filling by the metallic matrix, provide strength for resisting longitudinal forces applied to the distributor. The bristle structure furthermore insures that the regions which are least compressed upon assembly, particularly at the leading and trailing edges of the heat exchange tubes, contain an adequate volume of the fiber material.

The fiber material is suitably heat resistant to the operating temperatures acting on the structural parts, but it need not necessarily withstand oxidation and corrosion. When the fibers are completely immersed in the metallic matrix, they are thus protected from exposure to corrosive fluids. Therefore, metallic fibers can be used as well as ceramic and carbon fibers.

In the assembly of the heat exchanger, it may further be advantageous, in accordance with the invention, to surround the annular fiber strips with solid annular strips. The width of the solid strips corresponds to the narrowest local spacings of the heat exchange tubes in the heat exchange field, so that upon assembly, when the strips are pressed together, the solid strips will assure obtaining the required spacings. Since, in such arrangement, the solid strips must conform to the undulating shape around the heat exchange tubes in the tube matrix in the circumferential direction, it is necessary to shape the solid strips before assembly or to make the solid strips of deformable material so that they can assume the undulating shape during compression of the strips.

The filling of the fiber material with the metallic matrix material can be effected according to the invention as follows:

1. In vacuum ovens, a shaped injector apparatus is introduced into the tubular distributor, and the molten matrix material is injected and fills the fiber structure by capillary action whereupon the material solidifies and unites with the fibers and the tube surfaces. It may be desirable to close the ends of the tubes which extend into the interior of the distributor and reopen the tubes after completion of the filling operation.

2. Solid annular elements which may surround the fiber structure on the inside and on the outside may be made of a material which is fusible upon heating in the oven, i.e. solder material. The fusible material can penetrate by capillary action into the fiber structure to fill the matrix volume and produce intergrated bonds with the fiber material and the tubes. The heat exchange tubes and the fiber material can be subjected to a surface pretreatment in order to obtain better wetting and binding with the matrix filling material.

BRIEF DESCRIPTION OF THE FIGURES OF THE DRAWINGS

FIG. 1 is a perspective view, partly broken away, of a heat exchanger of cross-counterflow type for which the method of the invention is adapted.

FIG. 2 is a fragmentary sectional view through the heat exchange tubes of the heat exchanger in FIG. 1.

DETAILED DESCRIPTION OF PREFERRED EMBODIMENTS

Figure 3:
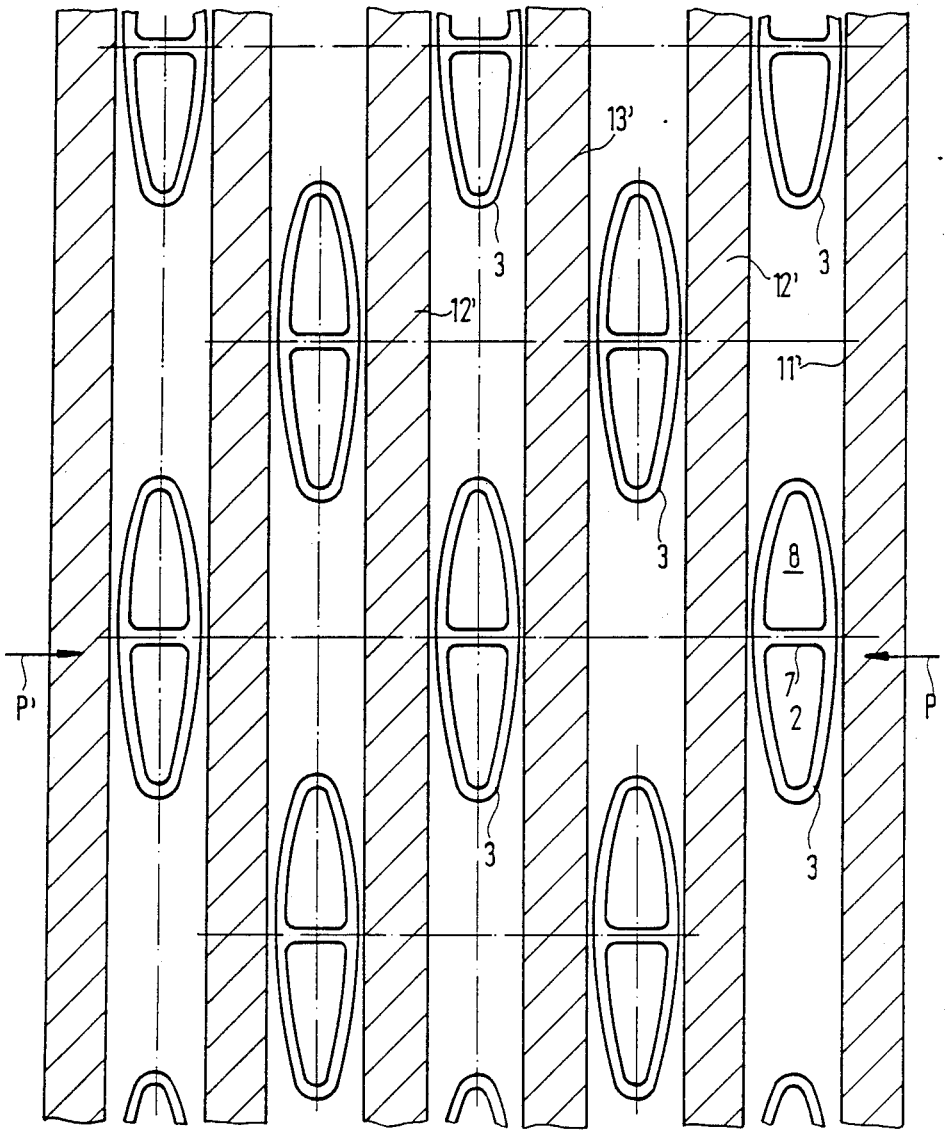
FIG. 3 is a sectional view, on enlarged scale, showing profiled heat exchange tubes interposed in rows between juxtaposed strips of material in an initial phase of the method of the invention.

FIG. 1 shows a heat exchanger 1 for carrying out heat exchange on a cross-counterflow basis between an external fluid G flowing around a matrix 2 of heat exchange tubes 3 which convey a second fluid D therein. The tubes 3 are formed with U-shaped bends and have straight legs connected respectively to a duct 4 in which fluid D is introduced in cold state and a duct 5 from which heated fluid is fed at D' to a utilization means (not shown). The external fluid G can be hot exhaust gases and the fluid D can be compressed air.

The ducts 4 and 5 are arranged in separated relation in a common distributor or manifold 6. The straight legs of tubes 3 extend laterally from duct 4 of distributor 6, in parallel relation to one another, up to the U-shaped bend regions in which the flow of compressed air is reversed by 180° and the compressed air flows in the other straight legs of the tubes 3 to the duct 5. The path of flow of the compressed air D in the tubes 3 is shown by arrows in FIG. 1. A respective tube matrix 2 is disposed at each lateral side of the distributor 6 and both tube matrixes are traversed by the hot gases G in a direction perpendicular to a median plane disposed between the parallel legs connected to ducts 4 and 5.

As seen in FIG. 2, the tubes 3 are streamlined in cross-section in the direction of flow of the hot gases G. The tubes 3 are arranged in the matrix 2 in rows and columns and the tubes in the rows overlap or interpenetrate between one another to provide smooth flow paths for the gases G.

Instead of the common distributor or collector tube 6, two or more separate distributors or collector tubes can be provided for the respective supply of compressed air into the matrix 2 and the removal of heated compressed air from the matrix 2.

The invention is directed to the manufacture of sheet structure 10 of the common distributor or collector tube 6 and is also applicable to the manufacture of a sheet structure for individual distributors of a heat exchanger of the type discussed above.

Figure 5:
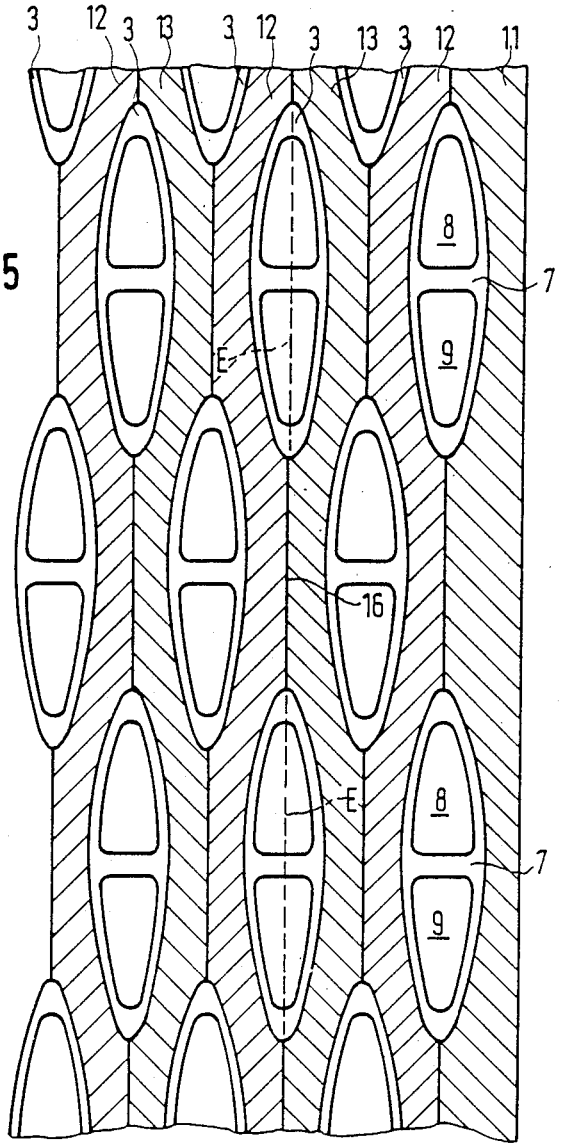
FIG. 5 is a sectional view of the assembly in FIG. 3 after application of compression forces and deforming of the strips of material.

In the method described herein, the sheet structure 10 forms the wall of distributor 6 and as shown in FIG. 5 comprises an integrated assembly of successive layers 11, 12 and 12, 13 of strips of material in which the heat exchange tubes 3 are embedded in fluid-tight manner.

Each of the layers is made of fiber material uniformly distributed in the layer. The fibers can be made of metallic material or wires, ceramic material, such as partially stabilized zirconium oxide or carbon.

Figure 6:
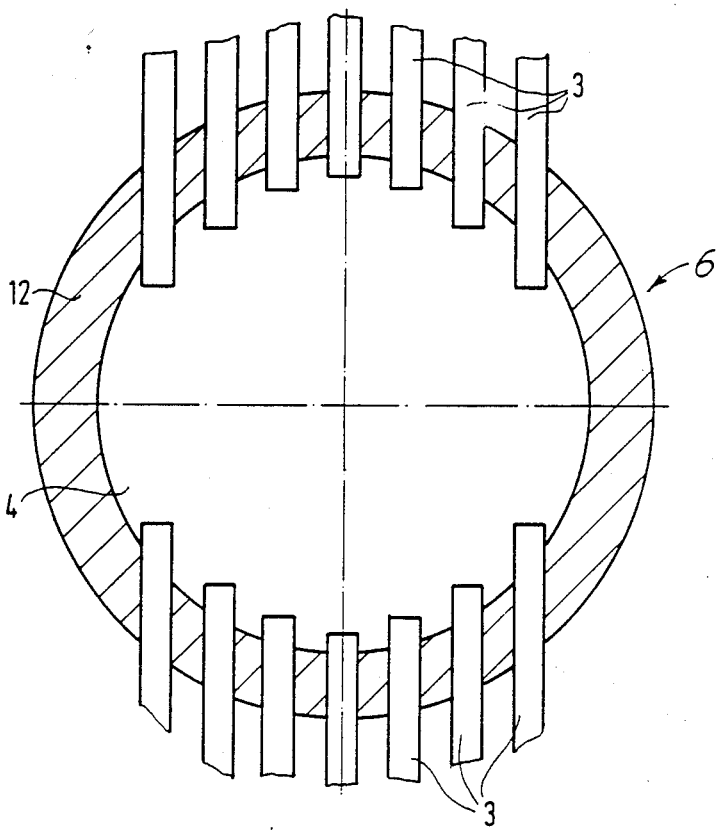
FIG. 6 is a transverse section taken in the direction of arrows 6—6 in FIG. 1 through the distributor showing the tubes extending into the distributor.

In a first stage of manufacture, layers 11', 12', 13' are disposed in spaced relation around the rows of tubes 3 as shown in FIG. 3 so that the tubes 3 are interposed between adjacent, juxtaposed layers. As shown in FIG. 6 for layer 12, the layers are annular and the ends of the tubes 3 extend through the layers into the interior of the distributor 6. An axial compressive force is applied to the end layers at P, P' to squeeze the strips and cause them to deform around the tubes such that each strip accomodates itself to one-half the cross-section of the tubes of each row while its fibers interconnect with the fibers of the adjacent strips. In this way, a porous structure is formed in which the tubes are encased.

A molten metallic material is then introduced into the porous structure as a matrix material to integrate the fibers of the layers to one another and to the ends of the tubes as a solid assembly in which the ends of the tubes are sealingly integrated.

Figure 4:
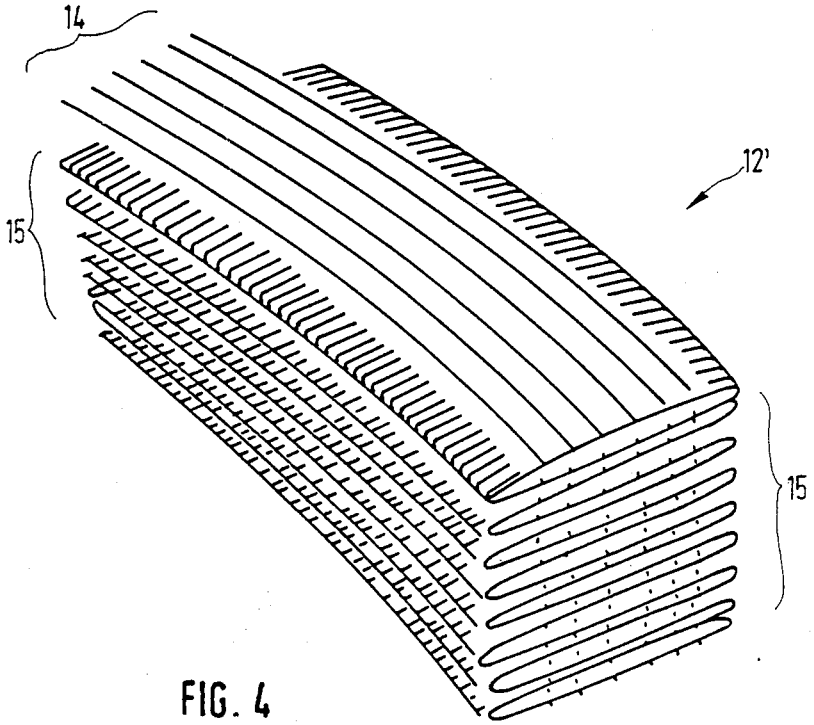
FIG. 4 is a perspective view diagrammatically illustrating a portion of a fiber strip.

As shown in FIG. 4, each layer, for example, layer 12' is formed from interwoven fiber plies or sublayers having main fibers 14 extending in the circumferential direction of the distributor and secondary fibers 15 extending transverse thereto. Upon the compressing and the deforming of the layers from the state shown in FIG. 4, the secondary fibers 15 interengage one another in the regions outside the tubes.

In the plane 16 where the adjacent juxtaposed strips come into contact with one another as shown in FIG. 5, the secondary fibers 15 of each strip intimately engage one another by interpenetration of the fiber bristles with one another. In this way an interbraiding of the fibers is obtained without formation of gaps even at the oval, streamlined ends of the tubes. The planes of contact 16 are aligned in the longitudinal planes of symmetry E (FIG. 5) of each row of tubes.

Figure 7:
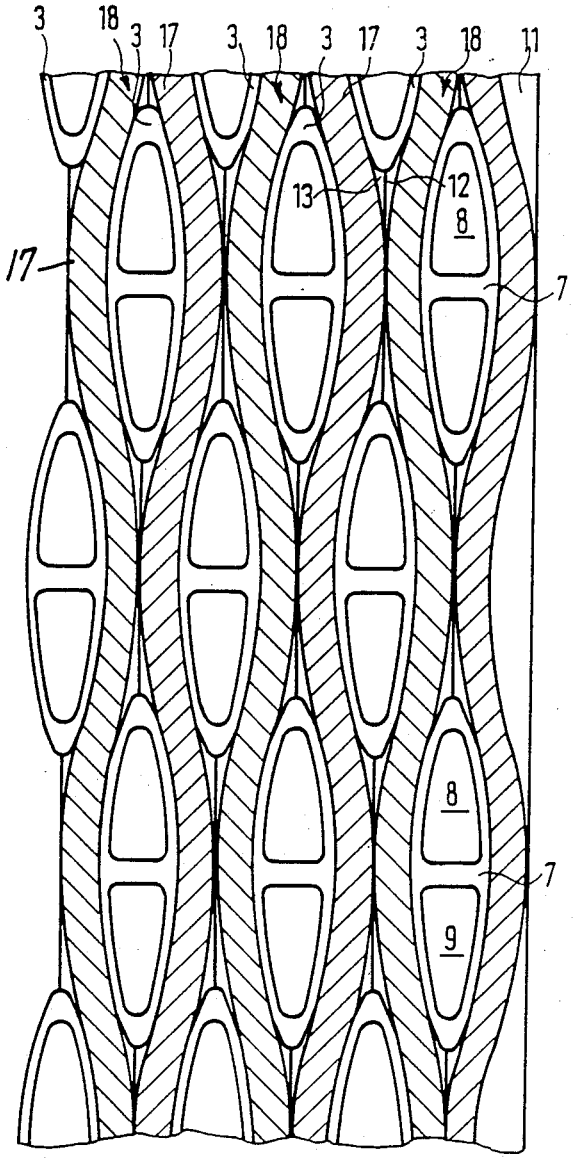
FIG. 7 shows the assembly in FIG. 5 in which undulating annular strips of solid material are mounted at the outer surface of the distributor.
Figure 8:
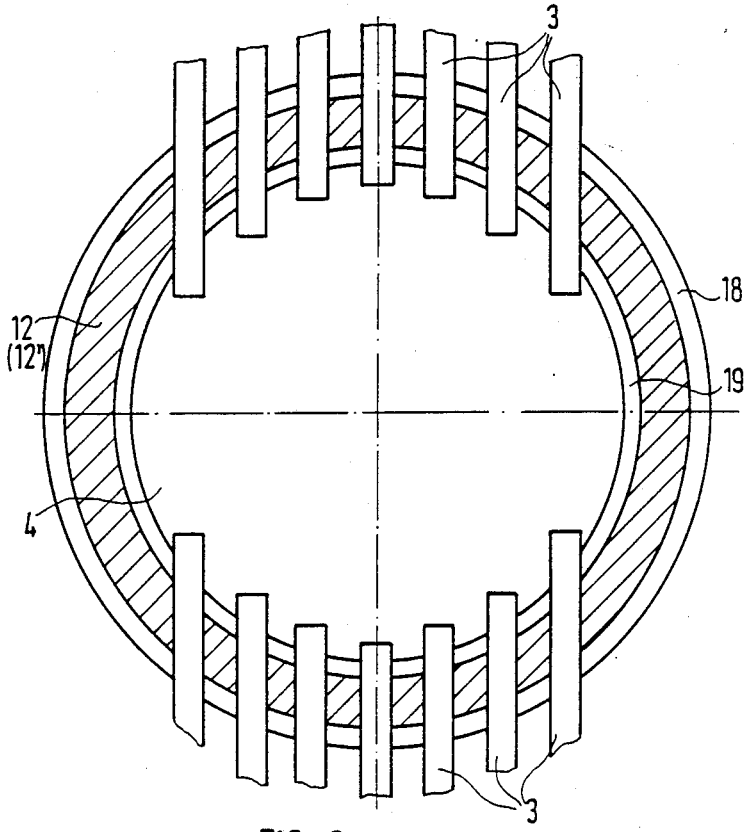
FIG. 8 is a view similar to FIG. 6 in which annular strips of solid material are employed in the manner shown in FIG. 7 at both the inner and outer surfaces of the tubular distributor.

As seen in FIGS. 7 and 8, cover elements 18, 19 can be respectively mounted on the outer and inner surfaces of the distributor 6 to cover the layers 11, 12, 13 formed from the fiber material. The layers 11, 12, 13 can be covered in whole or in part by the cover elements 18, 19.

The cover elements are composed of solid metallic ring elements and as seen in FIG. 7 for cover element 18, the ring elements are shown at 17 and are formed as undulating members which collectively surround the tubes. The ring elements 17 can serve to stiffen the structure of the distributor and to protect the layers of fiber material from environmental and temperature influences.

The ring elements 17 can also assist in the filling operation of the matrix material by preventing outflow of the injected molten material.

If, for example, the filling of the fiber layers with molten metallic material is effected from the outside of the distributor into the fiber material, then the ring elements 17 are arranged exclusively at the inner surface of the distributor to prevent outflow of the metallic material. After the filling operation is completed the ring elements 17 can be removed.

In a further development of the method of the invention, the metallic ring elements 17 are made of deformable material and when the layers 12',13' are deformed under compressive forces, the ring elements 17 are also deformed to undulated shape while assuring the necessary spacing of the tubes 3 in the distributor 6.

Instead of compressing the fiber layers and the ring elements concurrently, it is also possible for the metallic ring elements 17 to be initially undulated or preformed in accordance with the final shape and to be placed on the tubes at the inner and outer surfaces of the distributor 6 over the fiber layers 11, 12, 13 before filling with the metallic material.

In accordance with another advantageous variation of the invention, the metallic ring elements 17 can be made of the material which is to fill the porous structure. In this case, the ring elements 17 are placed on the tubes at the inner and outer surfaces of the porous structure and the ring elements 17 are of undulating shape to conform with the deformed layers.

An extremely practical manner of effecting the filling operation is to make the metallic ring elements 17 of a meltable matrix material and to heat the assembly in an oven to melt the matrix material and achieve filling of the porous material.

When no ring elements are used, a metallic composite material (matrix) can be injected in molten form, within a vacuum furnace, at the inner and outer surfaces of the distributor through oval shaped injectors which move over the undulated deformed layers of the porous structure (FIG. 5).

In a further development of the method of the invention, the ends of the profiled tubes 3 of the matrix which are open at the interior of the distributor can be closed by a metallic filling operation from within the distributor and after filling of the porous structure, the tube ends can be reopened by machining.

The metallic material which fills the porous structure as a matrix metal, can be an aluminum alloy.

The distributor 6 has been shown as a cylindrical element in FIGS. 1, 6 and 8, however, it can have any tubular shape and, for example, it can be square or rectangular. The process of filling the porous structure with the matrix metal can be carried out continuously over the entire circumference of the porous distributor structure.

Instead of making the ring elements 17 of metal, they can be made of a fiber-reinforced plastic material or of ceramic material.

Although the invention has been disclosed in connection with specific embodiments thereof, it will become apparent to those skilled in the art that numerous modifications and variations can be made within the scope and spirit of the invention as defined in the attached claims.

What is claimed is:

1. A method of producing a fluid distributor of a heat exchanger from a succession of juxtaposed strips in which the ends of heat exchange tubes are mounted in sealed relation, said method comprising assembling successive layers of juxtaposed strips of fiber material with the ends of rows of heat exchange tubes between adjacent strips, applying compressive forces to the strips to squeeze the strips and deform the strips around the tubes to form a porous structure in which the tubes are encased, and filling the porous structure with a liquid metallic material to integrate the fibers and the ends of the tubes as a solid assembly in which the ends of the heat exchange tubes are sealingly secured.

2. A method as claimed in claim 1 wherein said strips of fiber material are formed of annular shape so that the distributor is tubular.

3. A method as claimed in claim 1 wherein each strip of fiber material is formed with plies of longitudinal and transverse fibers and upon the application of the compressive forces to the strips, the transverse fibers become interengaged where the plies contact one another outside the tube ends.

4. A method as claimed in claim 1 wherein said tube ends extend through the strips for connecting an inner space within the assembly to the interior of the tubes, said assembly having an inner wall surface bounding said inner space and an outer wall surface, the method further comprising covering at least one of said wall surfaces.

5. A method as claimed in claim 4 wherein said strips of fiber material are formed of annular shape so that the distributor is tubular, said at least one wall surface being covered by an annular element, and removing said annular element after the porous structure is filled with the liquid metallic material.

6. A method as claimed in claim 5 wherein said at least one annular element is deformed together with the strips by said compressive forces.

7. A method as claimed in claim 5 comprising preforming said annular element in undulated form to correspond to the space which is formed between the tube ends after compression of the strips and placing the preformed annular element around the tube ends before filling the porous structure with liquid metallic material.

8. A method as claimed in claim 4 wherein said covering of said at least one wall surface is effected by a cover element made of said metallic material which upon heating becomes liquified and fills the porous structure.

9. A method as claimed in claim 8 wherein both the inner and outer wall surfaces are covered by respective cover elements, each cover element being formed by a plurality of undulating members surrounding the tubes and covering the deformed strips.

10. A method as claimed in claim 9 comprising heating the assembly of the tubes, porous structure and cover elements to melt the metallic material of the cover elements and effect the filling of the porous structure.

11. A method as claimed in claim 1 wherein the porous structure is filled with liquid metallic material by injecting said liquid metallic material into the porous structure in a vacuum oven.

12. A method as claimed in claim 11 comprising closing the heat exchange tubes before the injection of the liquid metallic material into the porous structure and opening the tubes after said injection.

13. A method as claimed in claim 1 wherein the fiber material of said strips comprises metal wires.

14. A method as claimed in claim 1 wherein the fiber material of said strips comprises ceramic material.

15. A method as claimed in claim 14 wherein said ceramic material comprises partially stabilized zirconium oxide.

16. A method as claimed in claim 15 wherein said metallic material which fills the porous structure comprises an aluminum alloy.

17. A method as claimed in claim 1 wherein the fiber material comprises carbon fibers.

18. A method as claimed in claim 1 wherein the ends of the heat exchange tubes are interposed in said rows between adjacent strips of material.

19. A method as claimed in claim 1 wherein said strips are endless and collectively define a wall of tubular shape for the distributor from which said heat exchange tubes extend, said tubes being of U shape and having straight legs extending in sealed relation through the wall of said distributor, said strips being assembled over the entire length of the distributor with the heat exchange tubes arranged in rows between adjacent strips before the compressive forces are applied to the strips and the resulting structure is filled with the liquid material.

20. A fluid distributor of a heat exchanger comprising a tubular distributor for a heat exchange fluid, and a plurality of heat exchange tubes sealingly connected to said distributor for flow of the heat exchange fluid between the distributor and the heat exchange tubes, said tubular distributor being constituted as an integrated assembly of a plurality of successive layers of juxtaposed strips of fiber material squeezed together and deformed around rows of said heat exchange tubes interposed between adjacent strips and a metallic material filling said strips of fiber material.

* * * * *